US009611581B2

(12) United States Patent
Seo et al.

(10) Patent No.: US 9,611,581 B2
(45) Date of Patent: Apr. 4, 2017

(54) WASHING MACHINE

(71) Applicant: SAMSUNG ELECTRONICS CO., LTD., Suwon-si, Gyeonggi-do (KR)

(72) Inventors: Dong Pil Seo, Hwaseong-si (KR); Tai Eun Kim, Suwon-si (KR); Sang Yeon Pyo, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 233 days.

(21) Appl. No.: 14/503,890

(22) Filed: Oct. 1, 2014

(65) Prior Publication Data

US 2015/0184326 A1 Jul. 2, 2015

(30) Foreign Application Priority Data

Dec. 27, 2013 (KR) ..... 10-2013-0165899

(51) Int. Cl.

| | |
|---|---|
| ***D06F 37/24*** | (2006.01) |
| ***D06F 37/20*** | (2006.01) |
| ***D06F 37/26*** | (2006.01) |
| ***D06F 31/00*** | (2006.01) |
| *D06F 17/06* | (2006.01) |

(52) U.S. Cl.

CPC ..... *D06F 37/24* (2013.01); *D06F 31/00* (2013.01); *D06F 37/20* (2013.01); *D06F 37/267* (2013.01); *D06F 17/06* (2013.01)

(58) Field of Classification Search

None

See application file for complete search history.

(56) References Cited

U.S. PATENT DOCUMENTS 3,481,162 A * 12/1969 Ziegler ..... D06F 13/00 68/18 F
3,575,020 A * 4/1971 Hubbard ..... D06F 33/02 68/12.19
4,225,992 A * 10/1980 Morey ..... D06F 35/00 8/158
5,133,472 A * 7/1992 Koda ..... B65D 25/30 220/769
5,765,404 A * 6/1998 Fanson ..... D06F 37/24 68/23.2

(Continued)

FOREIGN PATENT DOCUMENTS

KR 20150030806 A * 3/2015 ..... D06F 37/12

*Primary Examiner* — Michael Barr
*Assistant Examiner* — Cristi Tate-Sims
(74) *Attorney, Agent, or Firm* — Staas & Halsey LLP

(57) ABSTRACT

A washing machine which comprises a fixing unit configured to fix an auxiliary laundry tub located in a rotary tub. The washing machine includes a cabinet, a tub disposed in the cabinet to store wash water, a rotary tub installed in the tub to be rotatable, a balancer coupled to an upper portion of the rotary tub to offset an unbalanced load of the rotary tub, an auxiliary laundry tub disposed in the rotary tub to be removably coupled to the balancer, and a fixing unit installed at the auxiliary laundry tub to be coupled to the balancer and to restrict up and down movement of the auxiliary laundry tub when the rotary tub is operated. Therefore, since the auxiliary laundry tub and the balancer may be stably coupled with each other, the auxiliary laundry tub is prevented from be separated during a washing process.

28 Claims, 8 Drawing Sheets

(56) References Cited

U.S. PATENT DOCUMENTS

| | | | | |
|---|---|---|---|---|
| 2004/0148977 | A1* | 8/2004 | Hartwig | D06F 37/245 68/23.2 |
| 2013/0327098 | A1* | 12/2013 | Bae, II | D06F 37/203 68/13 R |

* cited by examiner

WASHING MACHINE

CROSS-REFERENCE TO RELATED APPLICATIONS

This application claims the priority benefit of Korean Patent Application No. 10-2013-0165899, filed on Dec. 27, 2013 in the Korean Intellectual Property Office, the disclosure of which is incorporated herein by reference.

BACKGROUND

1. Field

Example embodiments of the present disclosure relate to a washing machine, and more particularly, to a washing machine comprising a fixing unit configured to fix an auxiliary laundry tub located in a rotary tub.

2. Description of the Related Art

A washing machine is an apparatus for cleaning clothes using electric power. The washing machine may be generally divided into an automatic washing machine in which laundry and wash water are stirred through rotation of a pulsator, and thus a water stream is generated to clean the laundry, and a drum type washing machine in which the laundry falls down and is cleaned by a lifter formed at a drum.

The automatic washing machine includes a tub configured to store the wash water, a rotary tub installed in the tub to be rotatable, the pulsator installed at a bottom of the rotary tub to be rotatable, and a driving device configured to rotate the rotary tub and the pulsator. When the rotary tub and the pulsator are rotated in a state in which the laundry and the wash water are put into the rotary tub, the pulsator stirs the laundry put into the rotary tub together with the wash water and removes dirt from the laundry.

Recently, an auxiliary laundry tub has been installed in the rotary tub so that the laundry can be classified and separately cleaned. Therefore, since the laundry may be separately cleaned according to the kind thereof, using the washing machine may be temporally and economically efficient.

The auxiliary laundry tub is coupled with a balancer disposed above the rotary tub and installed above the rotary tub. The auxiliary laundry tub and the balancer have a hooking protrusion and a hooking groove corresponding to each other, and thus the auxiliary laundry tub is hooked with the balancer. However, the auxiliary laundry tub coupled by only the hooking protrusion and hooking groove may be separated from the balancer due to vibration generated upon a spin drying cycle. As a result, the protrusion may become damaged when the weight of the auxiliary laundry tub is centered thereon.

SUMMARY

Therefore, it is an aspect of the present disclosure to provide a washing machine in which a coupling structure between an auxiliary laundry tub and a balancer is improved so that the auxiliary laundry tub and the balancer are stably coupled with each other.

It is another aspect of the present disclosure to provide a washing machine which uses a sensor configured to check whether the auxiliary laundry tub is stably coupled with the balancer, and thus enhances user convenience.

Additional aspects of the present disclosure will be set forth in part in the description which follows and, in part, will be obvious from the description, or may be learned by practice of the present disclosure.

In accordance with one aspect of the present disclosure, a washing machine includes a cabinet, a tub disposed in the cabinet to store wash water, a rotary tub installed in the tub to be rotatable, a balancer coupled to an upper portion of the rotary tub to offset an unbalanced load of the rotary tub, an auxiliary laundry tub disposed in the rotary tub to be removably coupled to the balancer, and a fixing unit installed at the auxiliary laundry tub to be coupled to the balancer and to restrict up and down movement of the auxiliary laundry tub when the rotary tub is operated.

The fixing unit may include at least one coupling protrusion formed along an outer circumferential surface of the auxiliary laundry tub, and the balancer may include at least one coupling groove formed along an inner circumferential surface of the balancer so that the at least one coupling protrusion is inserted thereinto.

The balancer may include at least one fixing groove formed along the inner circumferential surface of the balancer to be opposite to the at least one coupling groove, and the fixing unit may include at least one fixing protrusion formed to be inserted into the at least one fixing groove.

The fixing unit may include a fixing member comprising the at least one fixing protrusion, and an operation member connected to the fixing member.

The auxiliary laundry tub may include a frame portion configured to radially protrude from an upper surface of the auxiliary laundry tub and form the at least one coupling protrusion, and at least one installation hole may be provided at the frame portion.

A first supporting part configured to be rotatably coupled with the operation member may be formed at an upper surface of the frame portion, and a second supporting part configured to be rotatably coupled with the fixing member may be formed at a lower surface of the frame portion.

The first supporting part and the second supporting part may be disposed adjacent to the installation hole, and the fixing unit may include a connection member configured to pass through the installation hole and connect the operation member and the fixing member.

The connection member may include at least one link device.

The connection member may include a first link configured to be connected with the operation member, a third link configured to be connected with the fixing member, and a second link configured to connect the first link and the third link.

The connection member may be moved as the operation member is rotated around the first supporting part, and the fixing member may be rotated around the second supporting part as the connection member is moved, and thus the at least one fixing protrusion may be coupled into and separated from the at least one fixing groove.

The at least one fixing protrusion may include a hook structure formed at one end thereof inserted into the at least one fixing groove, and the at least one fixing groove may include an internal groove corresponding to the hook structure.

The fixing member may include a fixing rotational shaft configured to be rotatably coupled to the second supporting part, at least one elastic member may be installed at the fixing rotational shaft, and the at least one elastic member may provide an elastic force to the fixing member, such that the fixing member is returned to an original state after the fixing member is rotated.

The at least one coupling groove and the at least one fixing groove may be formed along the inner circumferential surface of the balancer in a predetermined ratio, and the at least one coupling protrusion and the at least one fixing protrusion may be formed to correspond to the predetermined ratio, such that the at least one coupling protrusion is inserted into the at least one coupling groove and the at least one fixing protrusion is inserted into the at least one fixing groove.

The washing machine may further include a sensor configured to check whether the at least one fixing protrusion is settled into the at least one fixing groove.

The sensor may be installed at the operation member.

In accordance with another aspect of the present disclosure, a washing machine includes a cabinet, a tub disposed in the cabinet to store wash water, a rotary tub installed in the tub to be rotatable, a balancer provided at an upper side of the rotary tub to offset an unbalanced load of the rotary tub, and an auxiliary laundry tub disposed in the rotary tub and coupled to the balancer to be rotatable together with the rotary tub, wherein the auxiliary laundry tub comprises at least one coupling protrusion configured to be inserted into the balancer from an upper side of the balancer, and at least one fixing protrusion configured to be inserted into the balancer from a lower side of the balancer.

The balancer may include at least one coupling groove into which the at least one coupling protrusion is inserted, and at least one fixing groove into which the least one fixing protrusion is inserted, and the at least one coupling groove and the at least one fixing groove may be formed in an inner circumferential surface of the balancer.

The at least one coupling groove may have a downward concave shape, the at least one fixing groove may be located under the at least one coupling groove to have an upward concave shape, and the at least one coupling groove and the at least one fixing groove may be formed along the inner circumferential surface of the balancer in a predetermined ratio.

The fixing unit may include an operation member installed to be rotatable, and a fixing member including the at least one fixing protrusion and configured to be rotated as the operation member is rotated.

The auxiliary laundry tub may be coupled to the balancer so that the at least one coupling protrusion is inserted into the at least one coupling groove, the at least one fixing protrusion may be rotated and inserted into the at least one fixing groove, and thus the auxiliary laundry tub may be fixed to the balancer.

In accordance with still another aspect of the present disclosure, a washing machine includes a tub, a rotary tub located in the tub, an auxiliary laundry tub disposed in the rotary tub to separately perform a washing process, a balancer installed at an upper portion of the rotary tub so that the rotary tub is stably rotated, a fixing unit provided at the auxiliary laundry tub to fix the auxiliary laundry tub, a groove structure provided at the balancer to be coupled with the fixing unit, and a sensor configured to check whether the fixing unit is settled into the groove structure.

The groove structure may include at least one coupling groove, and at least one fixing groove provided to be opposite to the at least one coupling groove, and the fixing unit may include at least one coupling protrusion configured to be inserted into the at least one coupling groove, and the at least one fixing protrusion configured to be coupled into the at least one fixing groove.

The fixing unit may include an operation member provided at an upper surface of the auxiliary laundry tub, and a fixing member configured to be connected with the operation member and comprise at least one fixing protrusion.

The sensor may be installed at the operation member.

The auxiliary laundry tub may include a first supporting part configured to rotatably support the operation member, and the fixing protrusion may be rotated to be coupled into and separated from the at least one fixing groove as the operation member is rotated.

The at least one coupling groove and the at least one fixing groove may be formed along an inner circumferential surface of the balance in a predetermined ratio, and the at least one coupling protrusion and the at least one fixing protrusion may be formed to correspond to the predetermined ratio.

When the at least one fixing protrusion is settled into the at least one fixing groove, the operation member may be located to be in contact with the upper surface of the auxiliary laundry tub, and when the at least one fixing protrusion is separate from the at least one fixing groove, the operation member may be rotated to move away from the upper surface of the auxiliary laundry tub.

The sensor may be a contact sensor installed at one surface of the operation member, which is in contact with the upper surface of the auxiliary laundry tub, to determine a state of contact with the upper surface of the auxiliary laundry tub.

The washing machine may further include a tub located at an outer side of the rotary tub, and the sensor may include a light emitting part provided at the operation member, and a light receiving part provided at the tub to correspond to the light emitting part.

The light emitting part may be provided at one surface of the operation member facing the tub when the operation member is settled on the upper surface of the auxiliary laundry tub, and the light receiving part may be located on the same line as the light emitting part.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
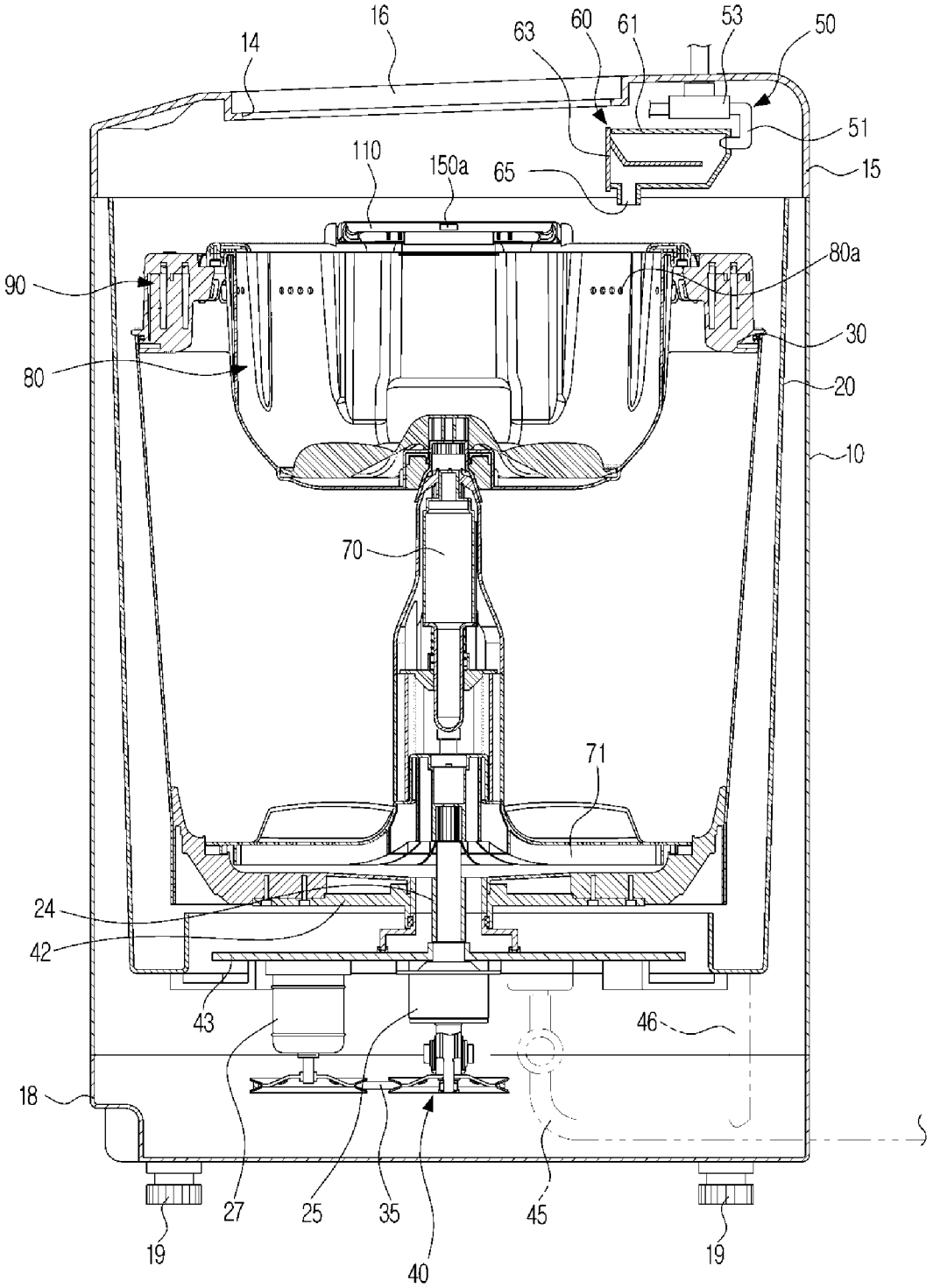
FIG. 1 is a cross-sectional view of a washing machine in accordance with an example embodiment of the present disclosure.

Reference will now be made in detail to the embodiments of the present disclosure, examples of which are illustrated in the accompanying drawings, wherein like reference numerals refer to like elements throughout.

FIG. 1 is a cross-sectional view of a washing machine 1 in accordance with an example embodiment of the present disclosure.

As illustrated in FIG. 1, a washing machine 1 includes a cabinet 10, a tub 20 disposed in the cabinet 10 to store wash water, a rotary tub 30 disposed in the tub 20 to be rotatable, and a driving device 40 configured to drive the rotary tub 30.

An upper cover 15 having a laundry inlet hole 14 through which laundry may be placed into the rotary tub 30 is provided at an upper portion of the cabinet 10, and a door 16 configured to open and close the laundry inlet hole 14 is provided at the upper cover 15.

A lower cover 18 to which a base part 19 for settling the washing machine 1 on a floor is coupled is provided at a lower portion of the cabinet 10. A suspension member (not shown) configured to suspend the rotary tub 30 to the cabinet 10 for support is connected to the upper portion of the cabinet 10.

The rotary tub 30 is rotatably disposed in the cabinet 10, and a plurality of through-holes (not shown) formed along a circumference of the rotary tub 30 are provided at an upper portion of the rotary tub 30. A balancer 90 configured to offset an unbalanced load caused due to rotation of the rotary tub 30 may be provided at the upper portion of the rotary tub 30.

An auxiliary laundry tub 80 may be removably coupled to the balancer 90. When the auxiliary laundry tub 80 is coupled to the balancer 90, the auxiliary laundry tub 80 is disposed in the rotary tub 30. Therefore, different kinds of laundry may be respectively received and separately washed in the rotary tub 30 and the auxiliary laundry tub 80, thereby improving washing efficiency. Further, when an amount of the laundry is small, the washing process may be performed in only the auxiliary laundry tub 80, and thus the wash water may be saved. The auxiliary laundry tub 80 may be separated from the balancer 90 and then may be used as a laundry basket for storing the laundry before and after washing.

A connection shaft 70 configured to couple the rotary tub 30 and the auxiliary laundry tub 80 so that the auxiliary laundry tub 80 can be rotated together with the rotary tub 30 when the rotary tub 30 is rotated may be disposed between the rotary tub 30 and the auxiliary laundry tub 80.

A pulsator 71 is rotatably installed at a bottom portion of the rotary tub 30. The pulsator 71 serves to stir the wash water together with the laundry that is placed into the rotary tub 30.

A water supply device 50 configured to supply the wash water into the rotary tub 30 is installed above the rotary tub 30. The water supply device 50 includes a water supply valve 53 configured to control water supply, and a water supply pipe 51 configured to connect the water supply valve 53 and a detergent supply device 60.

One side of the water supply pipe 51 is connected with an external water supply source (not shown), and the other side thereof is connected with the detergent supply device 60. The detergent supply device 60 includes a case 63 provided in the upper cover 15, and a detergent container 61 removably installed at the case 63 to receive each detergent. An outlet port 65 configured to discharge the wash water in which the detergent is dissolved is formed in a lower surface of the case 63. The water supplied through the water supply pipe 51 is supplied into the rotary tub 30 together with the detergent via the detergent supply device 60.

A first drain hose 45 and a second drain hose 46 configured to guide the wash water to an outside of the cabinet 10 after a washing process or a spin drying process are provided under the rotary tub 30.

The driving device 40 includes a clutch 25 configured to selectively rotate the rotary tub 30 and the pulsator 71, a driving motor 27 configured to drive the clutch 25, a flange member 42 configured to connect a driving shaft 24 of the clutch 25 and the bottom portion of the rotary tub 30 to transmit a rotational force of the driving shaft 24 to the rotary tub 30, and a base plate 43 configured to fix the clutch 25 and the driving motor 27. Further, a pulley 35 for fixing the clutch 25 and the driving motor 27 is included.

Figure 2:
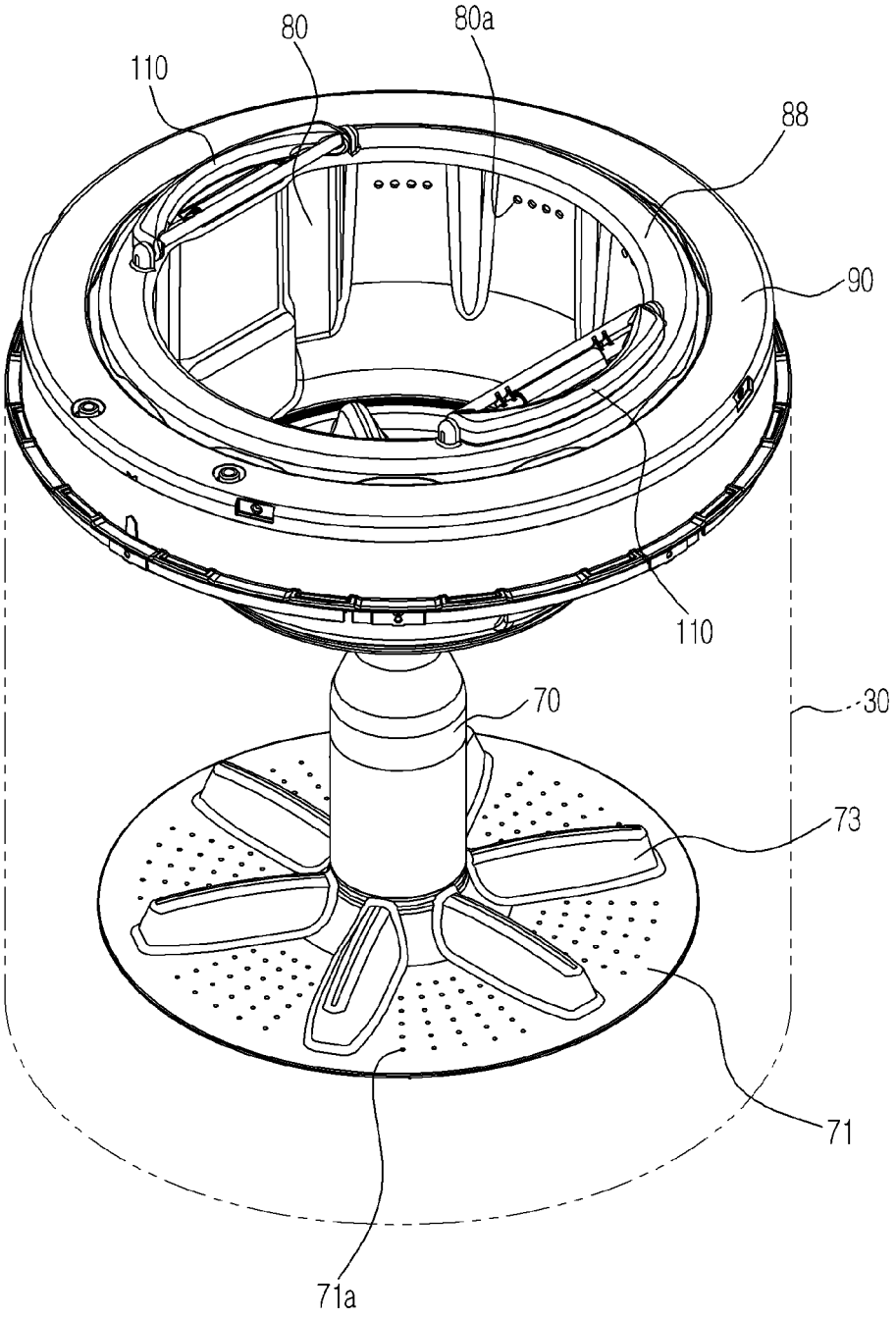
FIG. 2 is a view illustrating a coupling state of an auxiliary laundry tub, a balancer and a rotary tub of the washing machine in accordance with an example embodiment of the present disclosure.

FIG. 2 is a view illustrating a coupling state of the auxiliary laundry tub 80, the balancer 90 and the rotary tub 30 of the washing machine 1 in accordance with an example embodiment of the present disclosure.

The pulsator 71 is coupled to a lower surface of the rotary tub 30. Further, the balancer 90 may be coupled to an upper surface of the rotary tub 30. The auxiliary laundry tub 80 is coupled with the balancer 90 and the auxiliary laundry tub 80 is located inside the rotary tub 30.

The pulsator 71 of the rotary tub 30 may have a disc shape and form the lower surface of the rotary tub 30, however, the present disclosure is not limited thereto. A plurality of through-holes 71 a through which the wash water passes up and down through the pulsator 71 may be formed throughout the pulsator 71. The pulsator 71 may include a plurality of ridge portions 73 configured to protrude upward to push against the laundry, thereby moving the laundry. According to FIG. 2, six ridge portions 73 may be provided, however, the present disclosure is not limited thereto. As such, more or less than six ridge portions may be provided.

Further, the connection shaft 70 configured to extend from a center portion of the pulsator 71 may be provided. The driving shaft 24 may be coupled to the center portion of the pulsator 71 and also coupled to a lower portion of the connection shaft 70. Therefore, driving power of the driving motor 27 is transmitted to the auxiliary laundry tub 80 through the connection shaft 70. When the rotary tub 30 is rotated, the auxiliary laundry tub 80 may also be rotated together.

Since the auxiliary laundry tub 80 is provided separately from the rotary tub 30, general laundry and soft laundry may be separately washed. Thus, since the different kinds of laundry may be washed during one washing cycle, a washing process may be performed efficiently.

Further, since the washing process may be performed using the auxiliary laundry tub 80 having a smaller capacity than the rotary tub 30, the wash water may be conserved. When the auxiliary laundry tub 80 is not used, the auxiliary laundry tub 80 may be disassembled and then used as the laundry basket for storing the laundry.

Therefore, the auxiliary laundry tub 80 may be removably coupled to the balancer 90 according to whether a user uses the auxiliary laundry tub 80. The auxiliary laundry tub 80 may have a handle 110 so that the user may easily install and remove the auxiliary laundry tub 80. The handle 110 may be provided at both sides of the auxiliary laundry tub 80 to correspond to an upper surface of the auxiliary laundry tub 80.

Figure 3:
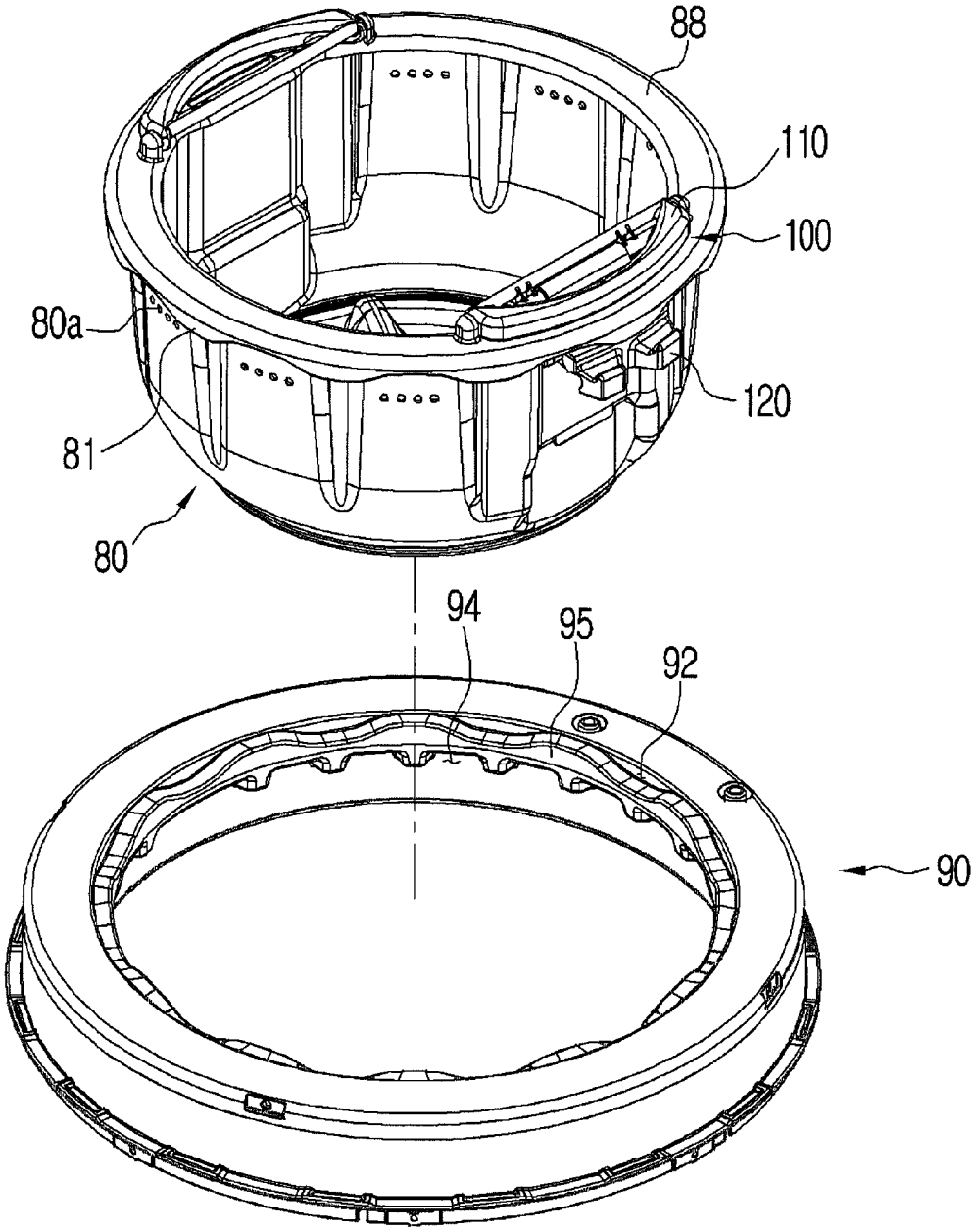
FIG. 3 is an exploded perspective view illustrating a state in which the auxiliary laundry tub and the balancer of the washing machine are disassembled in accordance with an example embodiment of the present disclosure.

FIG. 3 is an exploded perspective view illustrating a state in which the auxiliary laundry tub 80 and the balancer 90 of the washing machine 1 are disassembled in accordance with an example embodiment of the present disclosure.

The balancer 90 may have an annular shape having a predetermined thickness. A ball balancer (not shown) configured to offset rotational imbalance due to the laundry when the rotary tub 30 is rotated may be provided in the balancer 90.

The auxiliary laundry tub 80 may have a cylinder shape into which the laundry is placed. A frame portion 88 provided to protrude radially may be provided at the upper surface of the auxiliary laundry tub 80. A plurality of through-holes 80*a* may be provided in an outer surface of the auxiliary laundry tub 80. When the auxiliary laundry tub 80 is rotated, the wash water in the auxiliary laundry tub 80 may be discharged through the through-holes 80*a* by centrifugal force.

If the wash water is supplied into the auxiliary laundry tub 80 and arrives at a predetermined water level, the wash water is supplied into the rotary tub 30 through the through-holes 80*a* of the auxiliary laundry tub 80. In the spin drying process, while the auxiliary laundry tub 80 is rotated, the wash water passes through the through-holes 80*a*, and then is discharged through the drain hoses 45 and 46 provided at the rotary tub 30 to an outside.

The auxiliary laundry tub 80 may include a fixing unit 100 configured to restrict movement of the auxiliary laundry tub 80 when the rotary tub 30 is operated. The fixing unit 100 may be coupled with the balancer 90 so that the auxiliary laundry tub 80 is prevented from vibrating up and down and separating from the balancer 90.

The fixing unit 100 may include at least one coupling protrusion 81. The coupling protrusion 81 may be provided to protrude downward from one protruding end of the frame portion 88. The coupling protrusion 81 may be formed along an outer circumferential surface of the auxiliary laundry tub 80. The coupling protrusion 81 may be provided to extend in a circumferential direction in a wave shape, however, the present disclosure is not limited thereto.

A groove structure 95 coupled with the fixing unit 100 may be provided at the balancer 90. The groove structure 95 may include at least one coupling groove 92 formed so that the coupling protrusion 81 may be inserted therein. The coupling groove 92 may be formed along an inner circumferential surface of the balancer 90. The coupling groove 92 may be formed to have a shape corresponding to the coupling protrusion 81. Therefore, the coupling groove 92 may be provided to be depressed downward and also to extend in a circumferential direction in the wave shape. While the coupling groove 92 may be formed to have a shape corresponding to the coupling protrusion 91, the wave shape is an example, and thus, the present disclosure is not limited thereto.

The groove structure 95 may include at least one fixing groove 94 provided under the coupling groove 92. The fixing groove 94 may be formed to be depressed upward and thus to be opposite to the coupling groove 92. The fixing groove 94 may be provided to extend along the inner circumferential surface of the balancer 90 in a concavo-convex shape, however, the present disclosure is not limited to the concavo-convex shape.

The coupling groove 92 and the fixing groove 94 may be formed in a predetermined ratio to extend along the inner circumferential surface of the balancer 90. In FIG. 3, a ratio of two fixing grooves 94 to one coupling groove 92 is provided. That is, the coupling groove 92 and the fixing groove 94 extend along the inner circumferential surface of the balancer 90 so that the fixing grooves 94 are provided at both sides of the coupling groove 92.

The fixing unit 100 of the auxiliary laundry tub 80 may include at least one fixing protrusion 120 coupled with the fixing groove 94 of the balancer 90. The fixing protrusion 120 may be disposed under the coupling protrusion 81 protruding downward. Therefore, the coupling protrusion 81 is inserted into the coupling groove 92, and the fixing protrusion 120 is inserted into the fixing groove 94, and thus the auxiliary laundry tub 80 may be coupled with the balancer 90. At this time, since the coupling protrusion 81 is inserted from an upper side of the balancer 90 and the fixing protrusion 120 is inserted from a lower side of the balancer 90, the auxiliary laundry tub 80 and the balancer 90 may be stably coupled with each other.

To this end, the coupling protrusion 81 and the fixing protrusion 120 may be provided to correspond to a desired ratio in which the coupling grooves 92 and the fixing grooves 94 are formed. In FIG. 3, the fixing protrusion 120 is provided at both sides of the coupling protrusion 81 to correspond to the fixing grooves 94 provided at both sides of the coupling groove 92.

The fixing protrusion 120 may be rotatably provided so that the fixing groove 94 and the fixing protrusion 120 are coupled with each other after the auxiliary laundry tub 80 is inserted downward into the balancer 90 and thus the coupling groove 92 and the coupling protrusion 81 are coupled with each other.

The fixing unit 100 may include a fixing member 124 including an operation member 110 and the fixing protrusion 120. The operation member 110 may be provided to be rotatable, and the fixing member 124 may be connected with the operation member 110 to be rotated as the operation member 110 is rotated. Therefore, as the operation member 110 is rotated, the fixing protrusion 120 may also be rotated, and thus coupled to or separated from the fixing groove 94. The operation member 110 may be provided as the handle as described previously.

Figure 4:
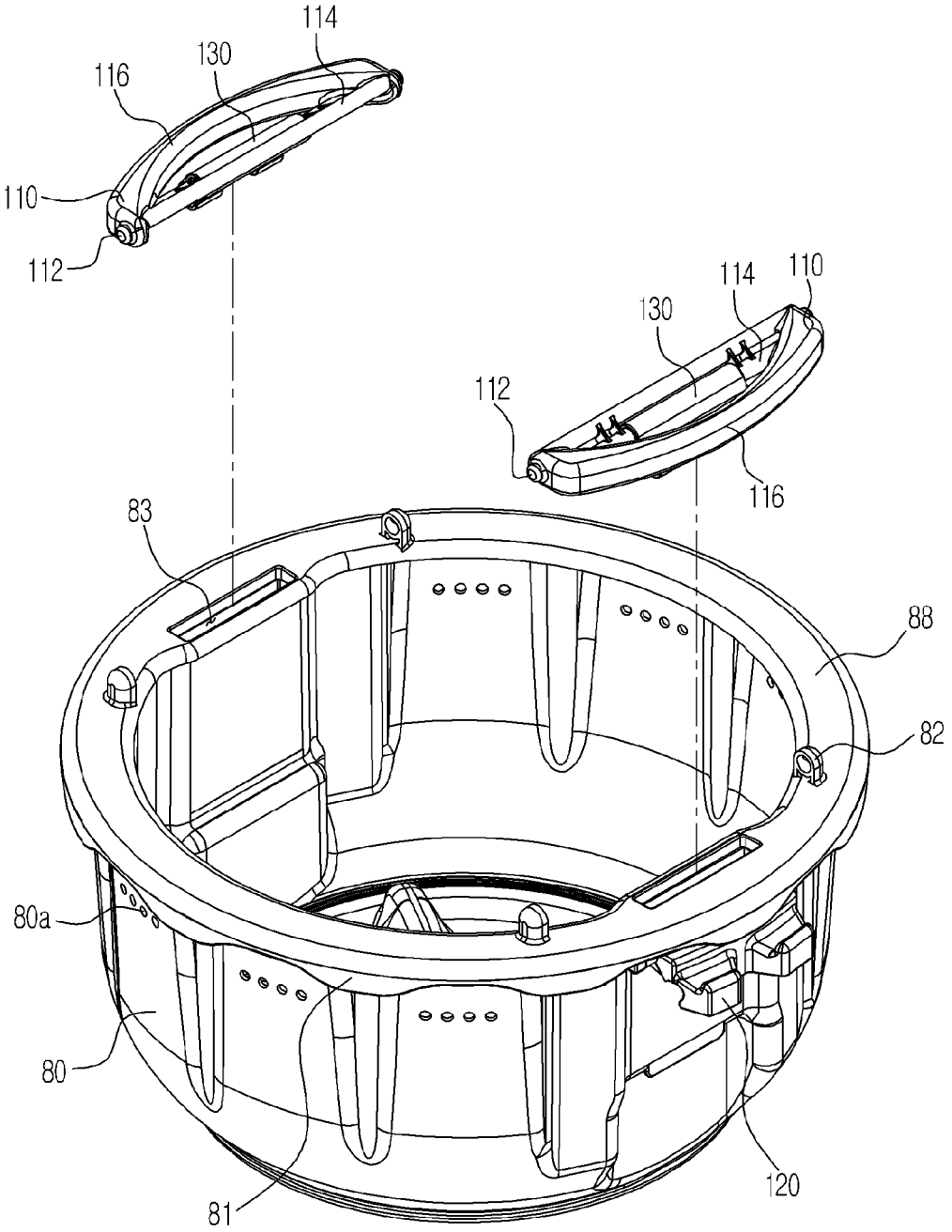
FIGS. 4 and 5 are exploded perspective views respectively illustrating a state in which the auxiliary laundry tub of the washing machine is disassembled in accordance with an example embodiment of the present disclosure.
Figure 5:
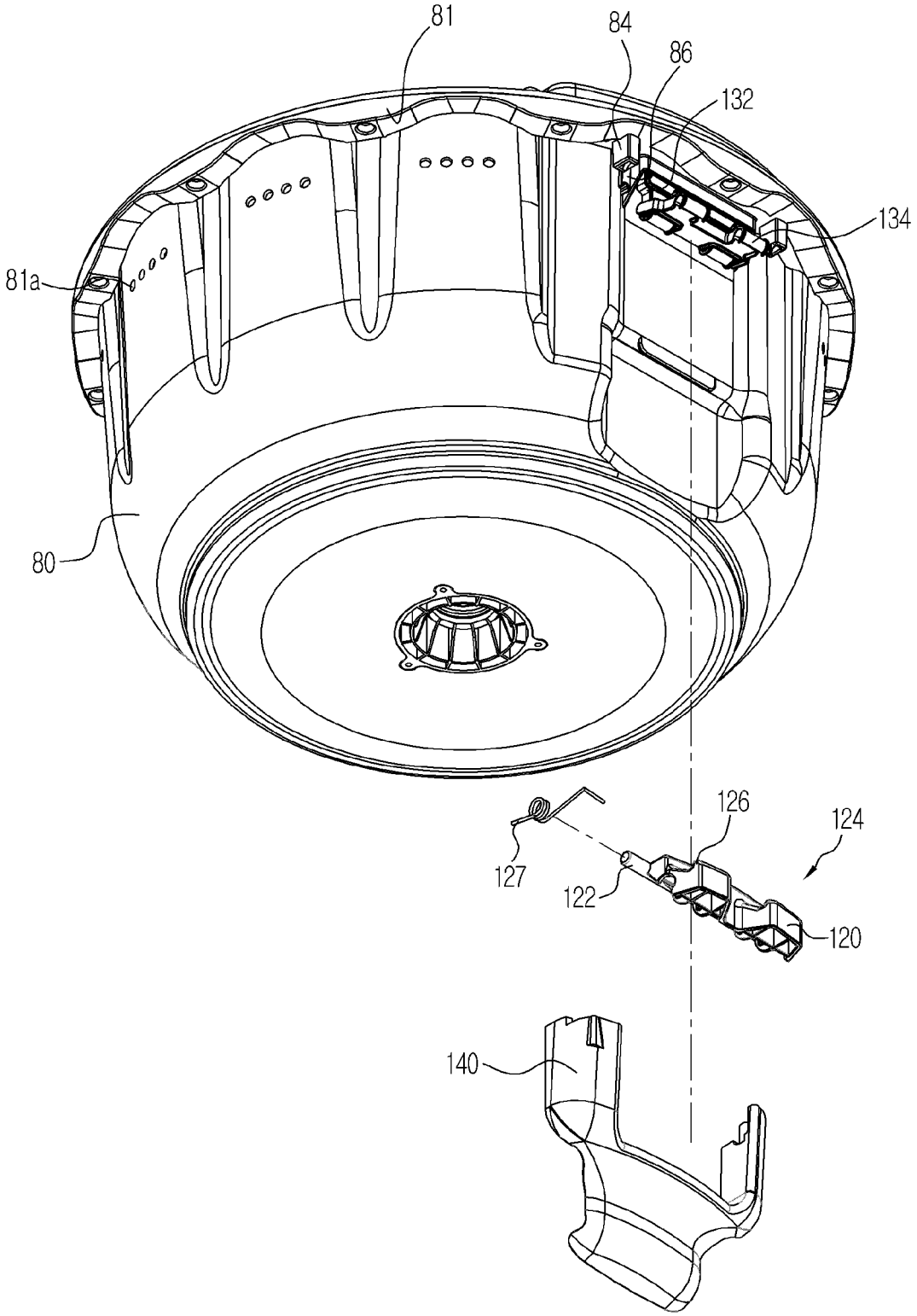
Figure 6:
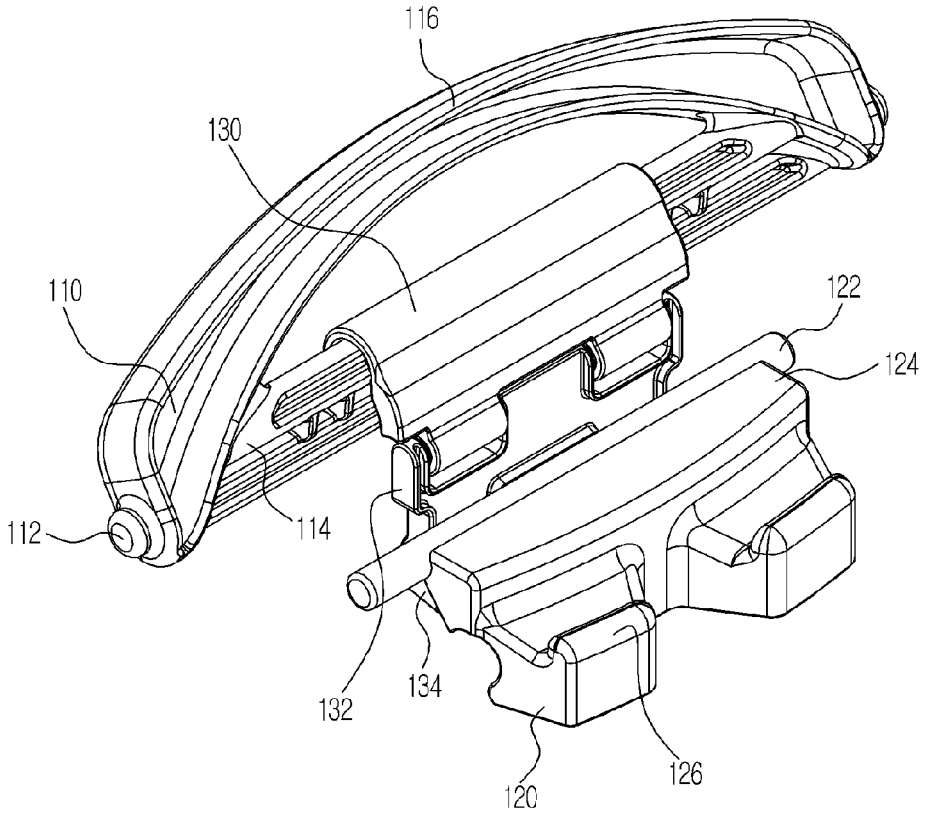
FIG. 6 is a view illustrating an operation member and a fixing member of the washing machine in accordance with an example embodiment of the present disclosure.

FIGS. 4 and 5 are exploded perspective views respectively illustrating a state in which the auxiliary laundry tub 80 of the washing machine 1 is disassembled in accordance with an example embodiment of the present disclosure, and FIG. 6 is a view illustrating the operation member 110 and the fixing member 124 of the washing machine 1 in accordance with an example embodiment of the present disclosure.

At least one installation hole 83 may be provided at the frame portion 88 of the auxiliary laundry tub 80. As illustrated in FIG. 4, the operation member 110 used as the handle is provided at the both sides of the auxiliary laundry tub 80, and the installation hole 83 of the frame portion 88 is provided at a position corresponding to the operation member 110.

As illustrated in FIG. 4, a first supporting part 82 which is rotatably coupled with the operation member 110 is provided at an upper surface of the frame portion 88. As illustrated in FIG. 5, a second supporting part 84 which is rotatably coupled with the fixing member 124 is provided at a lower surface of the frame portion 88.

The first and second supporting parts 82 and 84 may be disposed adjacent to the installation hole 83. The fixing unit 100 may include a connection member 130, 132, and 134 configured to pass through the installation hole 83 and connect the operation member 110 and the fixing member 124.

The connection member 130, 132, and 134 may include at least one link device. As illustrated in FIG. 6, the connection member 130, 132, and 134 may include a first link 130 connected with the operation member 110, a third link 134 connected with the fixing member 124, and a second link 132 configured to connect the first link 130 and the third link 134.

The operation member 110 may include an operation rotational shaft 112, a grasping part 116, and a coupling part 114 coupled with the first link 130. The operation rotational shaft 112 may protrude to both sides and be rotatably coupled to the first supporting part 82. The grasping part 116 may be disposed at a position opposite to the operation rotational shaft 112, such that the user may grasp the grasping part 116 and rotate the operation member 110. The coupling part 114 may be disposed in parallel with the operation rotational shaft 112, and may be moved up and down according to rotation of the operation rotational shaft 112.

The fixing member 124 may include a fixing rotational shaft 122, a coupling part 128 coupled with the third link 134, and a cover 140. The fixing rotational shaft 122 may protrude to both sides and be rotatably coupled to the second supporting part 84. The fixing rotational shaft 122 and the coupling part 128 may be provided to be spaced apart from each other a predetermined distance, such that the third link 134 moves and pulls the coupling part 128, and thus the fixing member 124 may be rotated. The at least one fixing protrusion 120 may be located at a position opposite to the fixing rotational shaft 122 to be coupled to and separated from the fixing groove 94. That is, the fixing rotational shaft 122, the coupling part 128 and the at least one fixing protrusion 120 may be disposed in turn.

At least one elastic member 127 may be installed at the fixing rotational shaft 122. The at least one elastic member 127 may provide elastic force so that the fixing member 124 is rotated and returned again. As illustrated in FIG. 5, the elastic member 127 may provided at one side of the fixing rotational shaft 122, and then an elastic member receiving part 86 may be provided to correspond thereto. The elastic member receiving part 86 may be disposed adjacent to the second supporting part 84, and the elastic member 127 may be installed and compressed at the elastic member receiving part 86.

The cover 140 is provided to cover the second supporting part 84 and the elastic member receiving part 86, such that the fixing member 124 may be stably rotated. The cover 140 may protrude to both sides thereof to cover the fixing rotational shaft 122 coupled to the second supporting part 84, and may also extend to a lower side of the fixing protrusion 120 to prevent rotation of the fixing protrusion 120 from being disturbed. Further, the cover 140 may cover the elastic member receiving part 86 and apply pressure to the elastic member 127.

As illustrated in FIG. 6, one end of the fixing protrusion 120 may include a hook structure 126 protruding upward. The fixing groove 94 may include an internal groove 93 depressed upward to correspond to the hook structure 126 (see also FIG. 7). As the fixing protrusion 120 is inserted into the fixing groove 94, the hook structure 126 is also inserted into the internal groove 93, and thus the auxiliary laundry tub 80 and the balancer 90 may be more stably coupled with each other.

Figure 7:
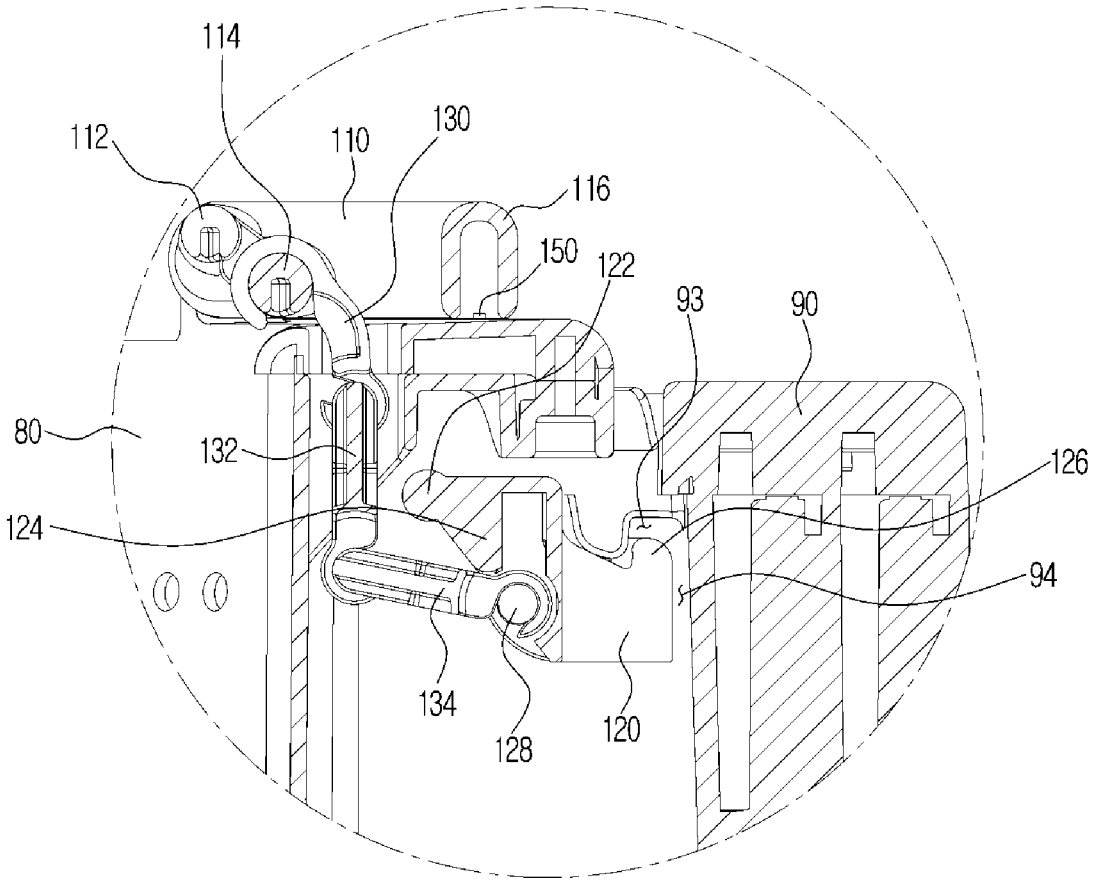
FIGS. 7 and 8 are views illustrating an operation of the operation member and the fixing member of the washing machine in accordance with example embodiments of the present disclosure.
Figure 8:
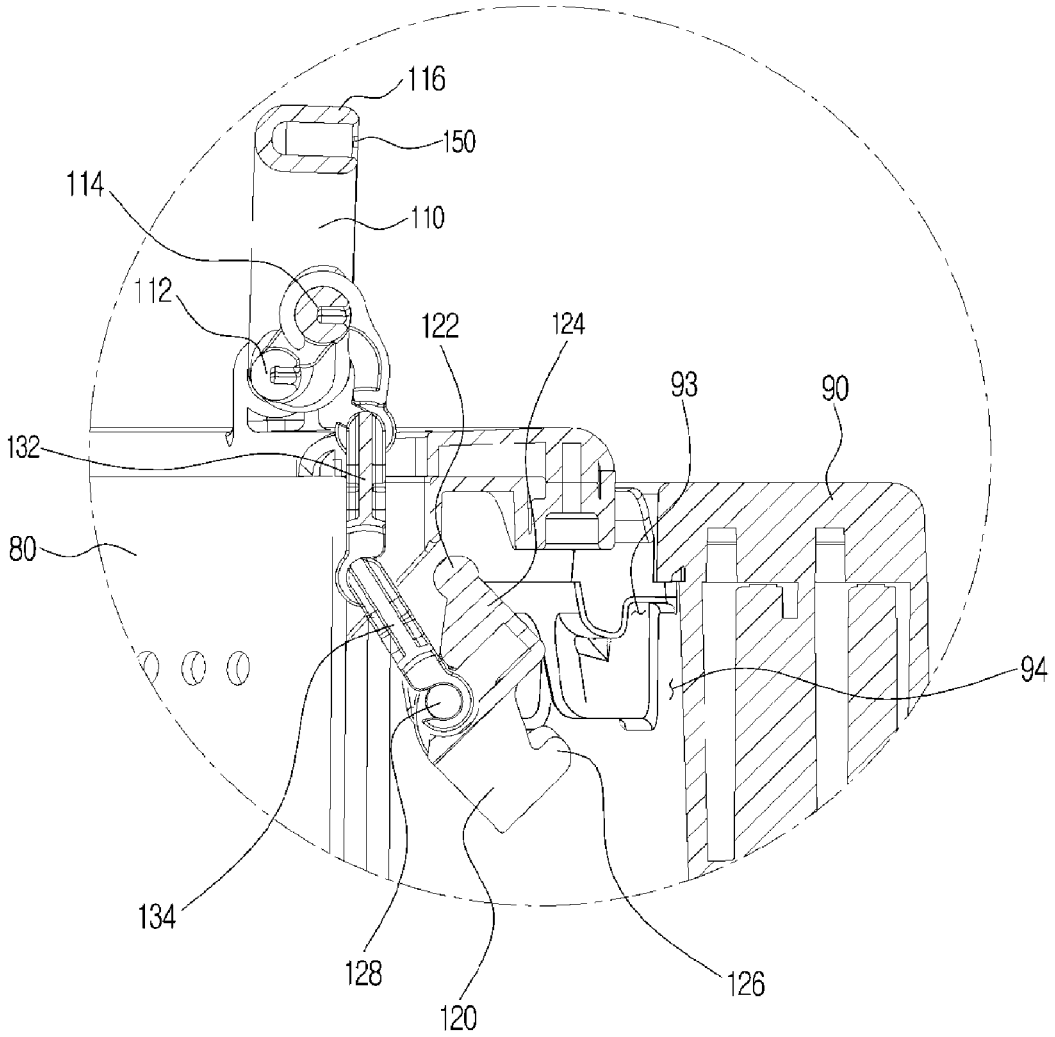

FIGS. 7 and 8 are views illustrating an operation of the operation member 110 and the fixing member 124 of the washing machine 1 in accordance with example embodiments of the present disclosure.

As illustrated in FIG. 7, if the operation member 110 is settled on the upper surface of the frame portion 88, the fixing protrusion 120 may be inserted into the fixing groove 94. At this time, the elastic member 127 does not receive any external force.

If the user grasps the grasping part 116 of the operation member 110 and applies an external force so that the grasping part 116 moves away from the upper surface of the auxiliary laundry tub 80, the operation rotational shaft 112 of which both ends are fixed to the first supporting part 82 is rotated. The grasping part 116 is rotated upward, and the coupling part 114 is moved upward. The first link 130 is moved upward according to the movement of the coupling part 114, and the second link 132 connected thereto is also moved.

One side of the third link 134 connected with the second link 132 is moved upward, and one side of the third link 134 connected with the fixing protrusion 120 is pulled toward an outer surface of the auxiliary laundry tub 80. Therefore, the fixing rotational shaft 122 of which both ends are fixed to the second supporting part 84 is rotated, and the fixing protrusion 120 is rotated.

At this time, the fixing rotational shaft 122 is rotated, and the elastic member 127 inserted thereinto receives compressing force. Therefore, if the external force applied to the operation member 110 is removed, the fixing member 124 may be returned again to its original state by the elastic force of the elastic member 127.

Therefore, the user grasps the fixing member 124 separately provided at both sides of the auxiliary laundry tub 80 and couples the auxiliary laundry tub 80 to the balancer 90 so that the coupling protrusion 81 is inserted into the coupling groove 92. Then, if the user releases the operation member 110 and removes the external force, the operation member 110 is settled on the upper surface of the frame portion 88, and the fixing protrusion 120 is rotated and then inserted into the fixing groove 94. That is, the coupling protrusion 81 is fixed to an upper portion of the balancer 90, and the fixing protrusion 120 is fixed to a lower portion of the balancer 90, and thus the auxiliary laundry tub 80 may be stably coupled to the balancer 90.

When the coupling protrusion 81 is settled into the coupling groove 92, the fixing protrusion 120 provided in the same ratio may also be settled into the fixing groove 94. On the other hand, when the fixing protrusion 120 and the fixing groove 94 are properly coupled with each other, the coupling protrusion 81 and the coupling groove 92 may also be properly coupled with each other. The washing machine 1 may include a sensor 150 configured to check whether the coupling protrusion 81 and the coupling groove 92, and the fixing protrusion 120 and the fixing groove 94 are properly coupled with each other. By an operation of the sensor 150, the user may easily and conveniently determine whether the auxiliary laundry tub 80 is properly coupled to the balancer 90.

When the fixing protrusion 120 is not settled into the fixing groove 94, this is because the fixing protrusion 120 is not completely rotated as illustrated in FIG. 7, and thus the operation member 110 may not be settled on the upper surface of the frame portion 88. Therefore, if the fixing protrusion 120 is not settled into the fixing groove 94, the operation member 110 is spaced apart from the upper surface of the frame portion 88.

Therefore, the sensor 150 is installed at the operation member 110, such that the user may determine whether the fixing protrusion 120 is settled into the fixing groove 94. As illustrated in FIGS. 7 and 8, the sensor 150 may be a contact sensor installed at one surface of the operation member 110 to determine a state of contact with the upper surface of the auxiliary laundry tub 80. The user may check whether the operation member 110 is in contact with the upper surface of the frame portion 88, and thus determine whether the auxiliary laundry tub 80 is properly coupled to the balancer 90.

As another embodiment, as illustrated in FIG. 1, the sensor may include a light emitting part 150*a* provided at the operation member, and a light receiving part (not shown) provided at the tub 20 to correspond to the light emitting part 150*a*. The light emitting part 150*a* may be provided at one surface of the operation member 110 facing the tub 20 when the operation member 110 is settled on the upper surface of the auxiliary laundry tub 80. The light receiving part (not shown) may be provided at an inner surface of the tub 20 which is disposed on the same line as the light emitting part 150*a*. Therefore, the user may check whether the light emitting part 150*a* and the light receiving part (not shown) are located to correspond to each other, and thus may determine whether the auxiliary laundry tub 80 is properly coupled to the balancer 90.

While a sensor being a light emitting part 150*a* is discussed above, the light emitting part is exemplary, and thus, the present disclosure is not limited thereto. As such, other types of sensors may also be used.

According to the present disclosure, since the auxiliary laundry tub and the balancer are stably coupled with each other, the auxiliary laundry tub is prevented from being separated during the washing process.

Further, since the user can check whether the auxiliary laundry tub is settled, it is possible to enhance user convenience.

According to the present disclosure, since the auxiliary laundry tub and the balancer are stably coupled with each other, the auxiliary laundry is prevented from being separated during the laundry process.

Further, since the user can check whether the auxiliary laundry tub is stably installed, user convenience can be enhanced.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine, comprising:

a cabinet;

a tub disposed in the cabinet to store wash water;

a rotary tub installed in the tub to be rotatable;

a balancer coupled to an upper portion of the rotary tub to offset an unbalanced load of the rotary tub, the balancer comprising at least one coupling groove formed along an inner circumferential surface of the balancer and at least one fixing groove formed along the inner circumferential surface of the balancer to be opposite to the at least one coupling groove;

an auxiliary laundry tub disposed in the rotary tub to be removably coupled to the balancer; and a fixing unit installed at the auxiliary laundry tub to be coupled to the balancer and to restrict up and down movement of the auxiliary laundry tub when the rotary tub is operated, the fixing unit comprising:

a fixing member comprising at least one fixing protrusion formed to be inserted into the at least one fixing groove of the balancer, and an operation member connected to the fixing member and configured to separate the at least one fixing protrusion of the fixing member from the at least one fixing groove of the balancer, wherein the fixing member is configured to be rotated as the operation member is rotated.

2. The washing machine of claim 1, wherein the fixing unit comprises at least one coupling protrusion formed along an outer circumferential surface of the auxiliary laundry tub, and the at least one coupling protrusion is inserted into the at least one coupling groove of the balancer.

3. The washing machine of claim 1, wherein the auxiliary laundry tub comprises a frame portion configured to radially protrude from an upper surface of the auxiliary laundry tub and form the at least one coupling protrusion, and at least one installation hole is provided at the frame portion.

4. The washing machine of claim 3, wherein a first supporting part configured to be rotatably coupled with the operation member is formed at an upper surface of the frame portion, and a second supporting part configured to be rotatably coupled with the fixing member is formed at a lower surface of the frame portion.

5. The washing machine of claim 4, wherein the first supporting part and the second supporting part are disposed adjacent to the installation hole, and the fixing unit comprises a connection member configured to pass through the installation hole and connect the operation member and the fixing member.

6. The washing machine of claim 5, wherein the connection member comprises at least one link device.

7. The washing machine of claim 5, wherein the connection member comprises a first link configured to be connected with the operation member, a third link configured to be connected with the fixing member, and a second link configured to connect the first link and the third link.

8. The washing machine of claim 5, wherein the connection member is moved as the operation member is rotated around the first supporting part, and the fixing member is rotated around the second supporting part as the connection member is moved, such that the at least one fixing protrusion is coupled into and separated from the at least one fixing groove.

9. The washing machine of claim 1, wherein the at least one fixing protrusion comprises a hook structure formed at one end thereof and is inserted into the at least one fixing groove, and the at least one fixing groove comprises an internal groove corresponding to the hook structure.

10. The washing machine of claim 8, wherein the fixing member comprises a fixing rotational shaft configured to be rotatably coupled to the second supporting part, at least one elastic member is installed at the fixing rotational shaft, and the at least one elastic member provides an elastic force to the fixing member such that the fixing member is returned to an original state after the fixing member is rotated.

11. The washing machine of claim 1, wherein the at least one coupling groove and the at least one fixing groove are formed along the inner circumferential surface of the balancer in a predetermined ratio, and the at least one coupling protrusion and the at least one fixing protrusion are formed to correspond to the predetermined ratio, such that the at least one coupling protrusion is inserted into the at least one coupling groove and the at least one fixing protrusion is inserted into the at least one fixing groove.

12. The washing machine of claim 1, further comprising a sensor configured to detect whether the at least one fixing protrusion is settled into the at least one fixing groove.

13. The washing machine of claim 12, wherein the sensor is installed at the operation member.

14. The washing machine of claim 1, wherein the fixing unit is configured to couple the auxiliary laundry tub and the balancer with each other, such that the auxiliary laundry tub is prevented from being separated from the balancer during a washing process.

15. The washing machine of claim 10, wherein when an external force rotates the fixing rotational shaft, the elastic member receives a compressing force, and when the external force is removed, the fixing member is returned to the original state by an elastic force of the elastic member.

16. The washing machine of claim 15, wherein when the external force is removed, the operation member is settled on an upper surface of a frame portion of the auxiliary laundry tub, and the at least one fixing protrusion is rotated and inserted into the at least one fixing groove.

17. A washing machine, comprising:

a cabinet;

a tub disposed in the cabinet to store wash water;

a rotary tub installed in the tub to be rotatable;

a balancer provided at an upper side of the rotary tub to offset an unbalanced load of the rotary tub;

an auxiliary laundry tub disposed in the rotary tub and coupled to the balancer to be rotatable together with the rotary tub; and a fixing unit comprising:

an operation member installed at the auxiliary laundry tub to be rotatable, at least one coupling protrusion configured to be inserted into the balancer from an upper side of the balancer, and a fixing member configured to be rotated as the operation member is rotated, and including at least one fixing protrusion configured to be inserted into at least one fixing groove of the balancer from a lower side of the balancer.

18. The washing machine of claim 17, wherein the balancer further comprises at least one coupling groove into which the at least one coupling protrusion is inserted, and the at least one coupling groove and the at least one fixing groove are formed in an inner circumferential surface of the balancer.

19. The washing machine of claim 18, wherein the at least one coupling groove is formed in a downward concave shape, the at least one fixing groove is located under the at least one coupling groove and is formed to have an upward concave shape, and the at least one coupling groove and the at least one fixing groove are formed along the inner circumferential surface of the balancer in a predetermined ratio.

20. The washing machine of claim 17, wherein the auxiliary laundry tub is coupled to the balancer so that the at least one coupling protrusion is inserted into the at least one coupling groove, the at least one fixing protrusion is rotated and inserted into the at least one fixing groove, and thus the auxiliary laundry tub is fixed to the balancer.

21. A washing machine, comprising:

a tub;

a rotary tub located in the tub;

an auxiliary laundry tub disposed in the rotary tub to separately perform a washing process;

a balancer installed at an upper portion of the rotary tub so that the rotary tub is stably rotated;

a groove structure provided at the balancer, the groove structure comprising:

at least one coupling groove, and at least one fixing groove provided to be opposite to the at least one coupling groove;

a fixing unit provided at the auxiliary laundry tub to fix the auxiliary laundry tub to the balancer and configured to be coupled with the groove structure, the fixing unit comprising:

at least one coupling protrusion configured to be inserted into the at least one coupling groove of the groove structure, at least one fixing protrusion configured to be coupled into the at least one fixing groove of the groove structure, an operation member provided at an upper surface of the auxiliary laundry tub, and a fixing member configured to be connected with the operation member and configured to be rotated as the operation member is rotated and comprising at least one fixing protrusion; and a sensor configured to detect whether the fixing unit is settled into the groove structure.

22. The washing machine of claim 21, wherein the sensor is installed at the operation member.

23. The washing machine of claim 21, wherein the auxiliary laundry tub comprises a first supporting part configured to rotatably support the operation member, and the fixing protrusion is rotated to be coupled into and separated from the at least one fixing groove as the operation member is rotated.

24. The washing machine of claim 23, wherein the at least one coupling groove and the at least one fixing groove are formed along an inner circumferential surface of the balancer in a predetermined ratio, and the at least one coupling protrusion and the at least one fixing protrusion are formed to correspond to the predetermined ratio.

25. The washing machine of claim 24, wherein, when the at least one fixing protrusion is settled into the at least one fixing groove, the operation member is located to make contact with the upper surface of the auxiliary laundry tub, and when the at least one fixing protrusion is separated from the at least one fixing groove, the operation member is rotated to move away from the upper surface of the auxiliary laundry tub.

26. The washing machine of claim 25, wherein the sensor is a contact sensor installed at one surface of the operation member, which is in contact with the upper surface of the auxiliary laundry tub, to determine a state of contact with the upper surface of the auxiliary laundry tub.

27. The washing machine of claim 25, further comprising a tub located at an outer side of the rotary tub, wherein the sensor comprises a light emitting part provided at the operation member, and a light receiving part provided at the tub to correspond to the light emitting part.

28. The washing machine of claim 27, wherein the light emitting part is provided at one surface of the operation member facing the tub when the operation member is settled on the upper surface of the auxiliary laundry tub, and the light receiving part is located on the same line as the light emitting part.

* * * * *